US006950065B2

(12) United States Patent
Ying et al.

(10) Patent No.: US 6,950,065 B2
(45) Date of Patent: Sep. 27, 2005

(54) MOBILE COMMUNICATION DEVICE

(75) Inventors: Zhinong Ying, Lund (SE); Kenneth Håkansson, Malmö (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 10/472,508

(22) PCT Filed: Mar. 18, 2002

(86) PCT No.: PCT/EP02/02972

§ 371 (c)(1),
(2), (4) Date: Apr. 1, 2004

(87) PCT Pub. No.: WO02/078124

PCT Pub. Date: Oct. 3, 2002

(65) Prior Publication Data

US 2004/0233109 A1 Nov. 25, 2004

Related U.S. Application Data

(60) Provisional application No. 60/278,751, filed on Mar. 27, 2001.

(30) Foreign Application Priority Data

Mar. 22, 2001 (GB) ..... 0107239

(51) Int. Cl.[7] ..... H01Q 1/38
(52) U.S. Cl. ..... 343/700 MS
(58) Field of Search ..... 343/700 MS, 702, 343/850, 851, 852, 895, 795; 455/89, 90

(56) References Cited

U.S. PATENT DOCUMENTS

| | | | |
|---|---|---|---|
| 4,259,670 | A | 3/1981 | Schiavone |
| 5,512,910 | A | 4/1996 | Murakami et al. |
| 5,585,810 | A | 12/1996 | Tsuru et al. |
| 6,166,694 | A | 12/2000 | Ying |

(Continued)

FOREIGN PATENT DOCUMENTS

| | | | |
|---|---|---|---|
| EP | 0610112 | A1 | 8/1994 |
| EP | 0892459 | A1 | 1/1999 |
| EP | 0942488 | A | 9/1999 |
| EP | 0993070 | A | 4/2000 |
| EP | 1052722 | A | 11/2000 |
| JP | 07131234 | | 5/1995 |
| JP | 10028013 | | 1/1998 |
| WO | WO98/44588 | A | 10/1998 |
| WO | WO00/03452 | A | 1/2000 |
| WO | WO00/36700 | | 6/2000 |
| WO | WO01/33665 | A | 5/2001 |
| WO | WO01/91233 | A | 11/2001 |

*Primary Examiner*—Don Wong
*Assistant Examiner*—Huedung X. Cao
(74) *Attorney, Agent, or Firm*—Potomac Patent Group PLLC

(57) ABSTRACT

A mobile communications device has a multifrequency band antenna with a low band portion (LB) tuned to a low frequency band, and a first high band portion (HB1) tuned to a first high frequency band at higher frequencies than the low frequency band. The low band portion (LB) and the first high band portion (HB1) have a common first grounding point (GP1), a common feeding point (FP) for feeding input signals to the antenna and for receiving signals from the antenna, and a first conductor portion (CP1), which forms part of the low band portion (LB) and of the first high band portion (HB1). The first conductor portion (CP1) is electrically connected to the first grounding point (GP1) and to the common feeding point (FP). A second high band portion (HB2) is coupled to the first conductor portion (CP1) and tuned to a second high frequency band at a higher frequency than the low frequency band and different from the first high frequency band. A switching network is connected between the second high band portion and ground, allowing the resonant frequency of the second high band portion to be varied, on the basis of a signal which depends on the operating mode of the device, thereby allowing four band operation.

16 Claims, 5 Drawing Sheets

U.S. PATENT DOCUMENTS 6,268,831 B1 7/2001 Sanford
6,552,686 B2 * 4/2003 Ollikainen et al. .. 343/700 MS
6,639,560 B1 * 10/2003 Kadambi et al. .... 343/700 MS
6,650,194 B1 * 11/2003 Kertis et al. ..... 331/117 R
6,650,295 B2 * 11/2003 Ollikainen et al. .. 343/700 MS
6,734,825 B1 * 5/2004 Guo et al. ..... 343/700 MS

* cited by examiner

MOBILE COMMUNICATION DEVICE

CROSS REFERENCE TO RELATED APPLICATIONS

This application claims the benefit of U.S. Provisional Application No. 60/278,751, filed Mar. 27, 2001, which is hereby incorporated herein by reference in its entirety. This application also claims priority under 35 U.S.C. §§ 119 and/or 365 to British Patent Application No. 0107239.6, filed on Mar. 22, 2001; the entire content of which is hereby incorporated by reference.

FIELD OF INVENTION

The invention relates to mobile communications devices such as mobile telephones, and in particular to antennas for such devices. Portable communications devices are required to be compact in size, which is a requirement that applies to every component of the devices, including the antenna. Modern mobile telephones use two or more distinct frequency bands, and it is preferable to use the same antenna in all frequency bands used by the telephone.

BACKGROUND OF THE INVENTION

Currently, many mobile telephones use one or more of the following three frequency bands: the GSM band centred on the frequency 900 MHz, the DSC band centred on 1800 MHz, and the PCS band centred on 1900 MHz. The 900 MHz and 1800 MHz frequency bands are separated by one octave, whereas the 1800 MHz and 1900 MHz frequency bands are separated by only a fraction of one octave. In many mobile telephones using the 900 MHz and 1800 MHz frequency bands, the antenna has separate portions tuned to respective ones of the two frequency bands, since it is not considered feasible to have one and the same portion of the antenna tuned to a frequency band of more than one octave, with a relatively large unused frequency band between the useful frequency bands.

U.S. Pat. No. 5,512,910 describes a microstrip antenna device having three resonance frequencies. However, an antenna of this type is too large to be used conveniently in a small mobile phone.

A known dual band antenna, as shown in U.S. Pat. No. 6,166,694, has a conductor portion, from which two spirals branch off. The two spirals are tuned to form a high band portion and a low band portion.

European Patent Application No. 00610112.5 (not published, and not forming part of the state of the art) describes an antenna of this type, housing a second conductor, which is capacitively coupled to the first conductor, and tuned to a second high frequency band.

It is the object of the invention to provide an antenna, which is usable in at least three frequency bands and which has the smallest possible loss, that is the maximum possible gain, in all frequency bands.

SUMMARY OF THE INVENTION

The invention provides an antenna for use in portable communications devices such as mobile telephones. The antenna is useful in a low frequency band and two high frequency bands, where the two high frequency bands are relatively closer to each other than to the low frequency band.

The antenna includes a first radiating element and a second radiating element. The first radiating element has two branches, which are tuned to a high frequency band and a low frequency band. The second radiating element is capacitively connected to the first radiating element, and has a tunable reactance loading, allowing the element to be tuned to a second high frequency band, which is separate from, but close to, the first high frequency band. The antenna is thus effectively a triple band antenna, and a mobile telephone having such an antenna is thus useful in three frequency bands. For example, a mobile telephone may be made in accordance with the invention, such that it is usable in the three frequency bands centred on 900 MHz, 1800 MHz and 1900 MHz respectively. However, the invention is not restricted to the use in the above-identified frequency bands, but will be suitable for use in existing and future frequency bands as well.

It should be emphasised that the term "comprises/comprising" when used in this specification is taken to specify the presence of stated features, integers, steps or components but does not preclude the presence or addition of one or more other features, integers, steps, components or groups thereof.

DETAILED DESCRIPTION OF THE PREFERRED EMBODIMENTS

The antenna according to the invention is described with reference to its use in a mobile phone. However, the invention is generally applicable to portable radio communication equipment or mobile radio terminals, such as mobile telephones, pagers, communicators, electronic organisers, smartphones, personal digital assistants (PDAs), or the like.

Figure 1:
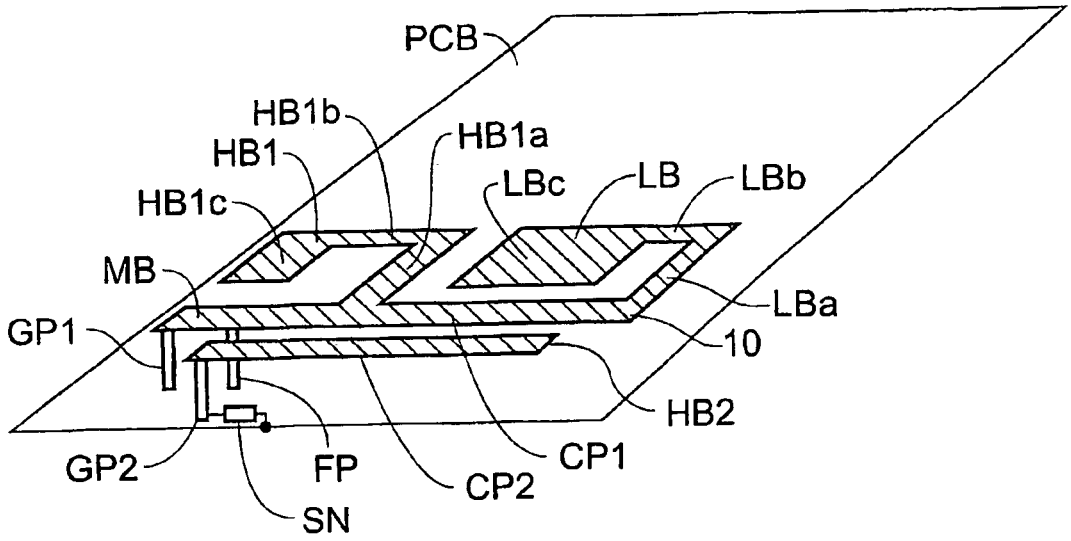
FIG. 1 schematically represents a preferred embodiment of a triple band antenna of the invention electrically connected to a printed circuit board.
Figure 2:
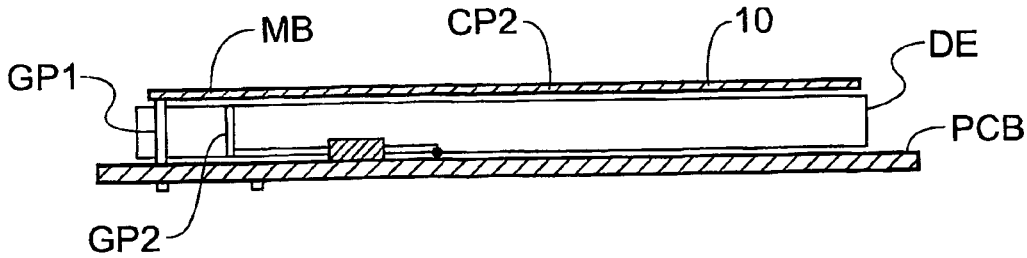
FIG. 2 is an end view of the antenna and printed circuit board of FIG. 1.
Figure 3:
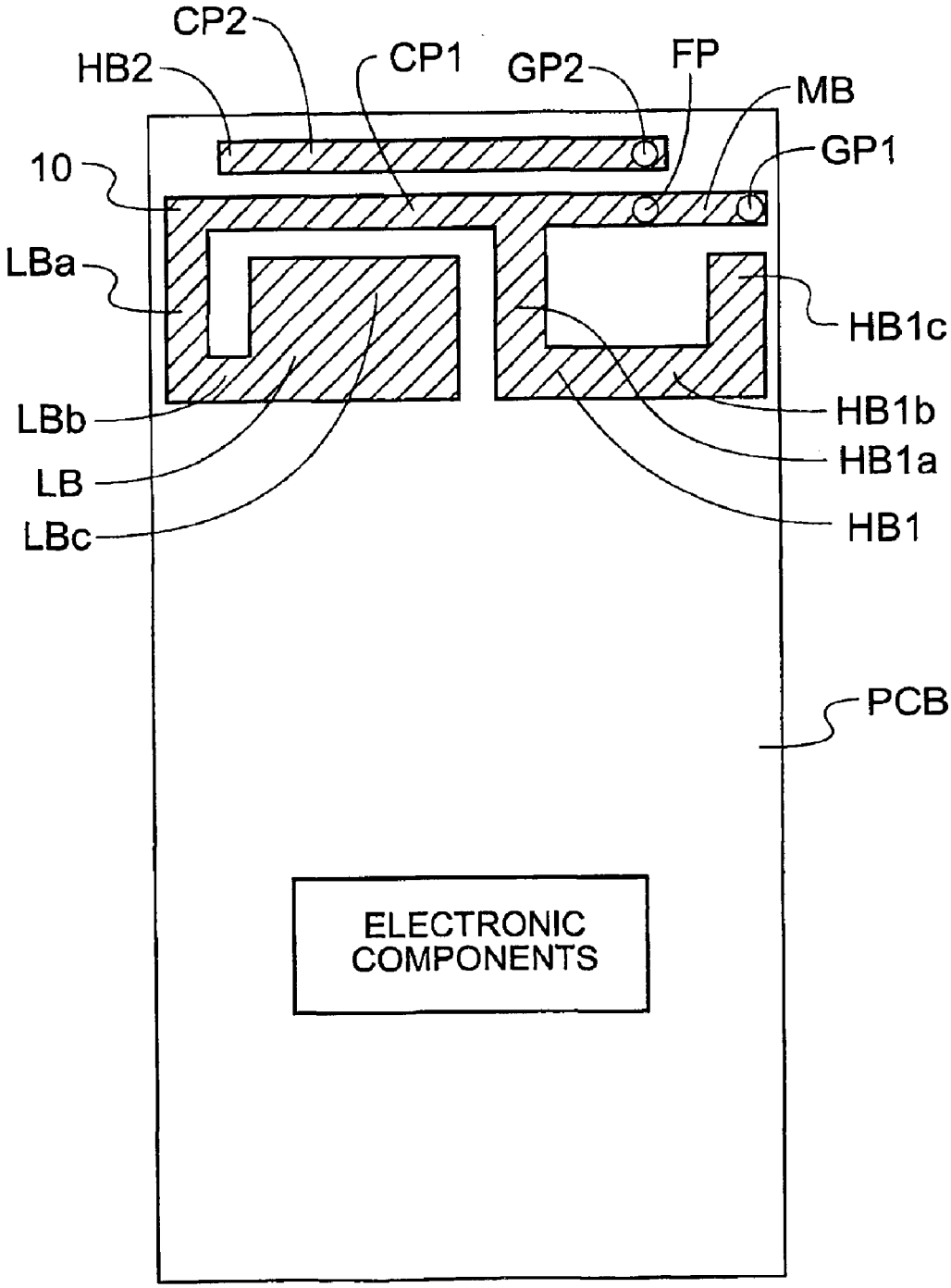
FIG. 3 schematically shows the printed circuit board with the antenna in FIG. 1.

FIGS. 1–3 show a printed circuit board PCB with an antenna 10 according to the invention, suitable for use in a mobile telephone. In the illustrated embodiment, the printed circuit board has a rectangular shape, but of course the invention is not restricted to the use of a rectangular shape. In practice, the printed circuit board will have a number of electronic components mounted thereon, which are necessary for the operation of the mobile telephone, but which are not part of the invention. In FIG. 3 such components are therefore indicated only schematically.

In FIGS. 1–3 an electrically conductive material, such as copper, constitutes the antenna 10 of the invention. The antenna is preferably spaced from the printed circuit board PCB with a predetermined distance therebetween. A first conductor portion CP1, which is rectilinear in this embodiment, has a ground point with a first grounding post GP1 at a first end of the first conductor portion CP1. In use, the grounding point will be electrically connected through the first grounding post GP1 to ground potential on the printed circuit board PCB. Near the first end, at a predefined distance therefrom, the first conductor portion CP1 has a feeding point with a feeding post FP electrically connecting the first conductor portion CP1 to an electronic circuit on the PCB for feeding the antenna with signals to be transmitted by the antenna, and/or to electronic circuitry for receiving signals received by the antenna.

The portion of the first conductor portion CP1 situated between the feeding post FP and the first grounding post GP1 functions as a matching bridge MB.

At a second end, opposite the first end, a low band portion LB branches off at one side of the straight first conductor portion CP1 and forms a spiral. Specifically, three rectilinear segments LBa, LBb, LBc, forming right angles with each other, constitute the low band spiral. The innermost segment LBc in the spiral is wider than the remaining three rectilinear segments including the first conductor portion CP1.

Between the first and second ends of the first conductor portion CP1, a first high band portion HB1, also forming a spiral, branches off at a right angle to the same side as the low band portion LB. The first high band spiral HB1 is also constituted by three rectilinear segments HB1*a*, HB1*b*, HB1*c*, forming right angles with each other. The segments constituting the first high band spiral could have substantially equal widths, the third segment HB1*c* could be wider than HB1*a* or HB1*b* as shown in FIG. 1, or other relative widths could be chosen.

The low band portion LB of the antenna is tuned to have a relatively low resonance frequency, such as 900 MHz, and a predefined bandwidth to define a low frequency band of the antenna. The low resonance frequency is mainly determined or influenced by the length of the low band portion LB measured from the feeding point FP to the inner end of the spiral, which length corresponds to one quarter of a wavelength at the low resonance frequency. When an electrical signal with frequencies in the low frequency band is fed to the feeding point FP of the antenna, corresponding electromagnetic signals will be radiated from the low band portion LB of the antenna as radio waves; and, vice versa, when the antenna receives electromagnetic signals in the form of radio waves with frequencies in the low frequency band, electrical signals will be generated by the low band portion LB of the antenna, and the thus generated electrical signals are sensed at the feeding post FP by receiving electronic circuitry connected to the antenna.

The first high band portion HB1 of the antenna is tuned to have a first high resonance frequency, and predefined bandwidth to define a first high frequency band. The first high resonance frequency is mainly determined or influenced by the length of the first high band portion HB1 measured from the feeding point FP to the inner end of the spiral, which length corresponds to one quarter of a wavelength at the first high resonance frequency. When an electrical signal with frequencies in the first high frequency band is fed to the feeding point FP of the antenna, corresponding electromagnetic signals will be radiated from the first high band portion HB1 of the antenna as radio waves, and, vice versa, when the antenna receives electromagnetic signals in the form of radio waves with frequencies in the first high frequency band, electrical signals will be generated by the first high band portion HB1 of the antenna, and the thus generated electrical signals are also sensed at the feeding point FP by receiving electronic circuitry connected to the antenna.

In accordance with the invention the antenna also has a second high band portion HB2 in the form of a second conductor portion CP2 arranged in a parallel relationship to the first conductor portion CP1 and at a predetermined distance therefrom. The first and second conductor portions are each typically 1.5–2.0 mm wide. At a first end, the second high band portion HB2 has a grounding point, which is electrically connected to a second grounding post GP2. The second grounding post GP2 is arranged close to feeding post FP, preferably at a distance of 0.5 mm, or at least in the range between 0.1 mm and 1.0 mm.

Together the first conductor portion CP1 and the second conductor portion CP2 form an electrical capacitor. A capacitive or parasitic coupling therefore exists between the first conductor portion CP1 and the second conductor portion CP2.

Further, the device includes a switching network SN, which is connected between the second grounding post GP2 and ground potential on the PCB. Thus, the grounding point of the second high band portion HB2 is electrically connected through the second grounding post GP2 and via the switching network SN to ground potential on the PCB.

Figure 4:
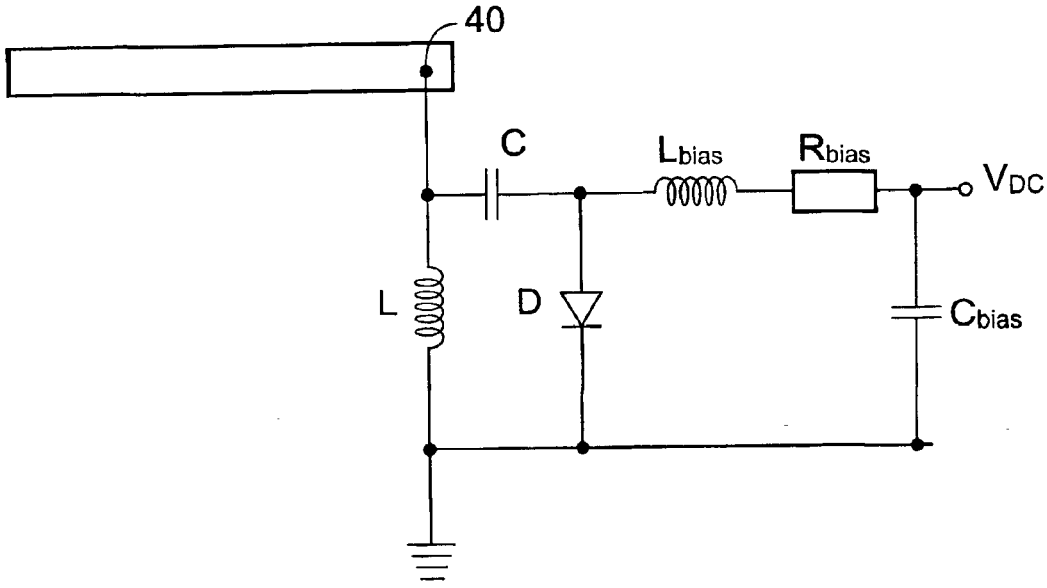
FIG. 4 is an electrical circuit diagram showing the tunable reactance loading of the antenna of the invention.

FIG. 4 shows the arrangement of the switching network SN, including an input 40 for connection to the second grounding post GP2. The input 40 is connected to ground through a reactive element, in this example an inductor L.

A capacitor C and a PIN diode D are connected in parallel with the inductor L. A serial link consisting of a further inductor Lbias and a resistor Rbias is connected to the anode of the diode D, and fed with a bias voltage VDC. A further capacitor Cbias is connected between the bias voltage VDC and ground.

Thus, depending on the value of the bias voltage VDC, the reactance connected between the input 40 and ground will vary. The diode D operates as a switch such that, when a specific value of the bias voltage VDC is applied, the inductor L is shorted out of the circuit, thereby altering the reactance of the switching network SN which is connected between the input 40 and ground.

Other switching networks, for example using varactor diodes or a Micro ElectroMechanical System (MEMS) can be used to provide a variable reactance in a somewhat similar way.

Figure 5:
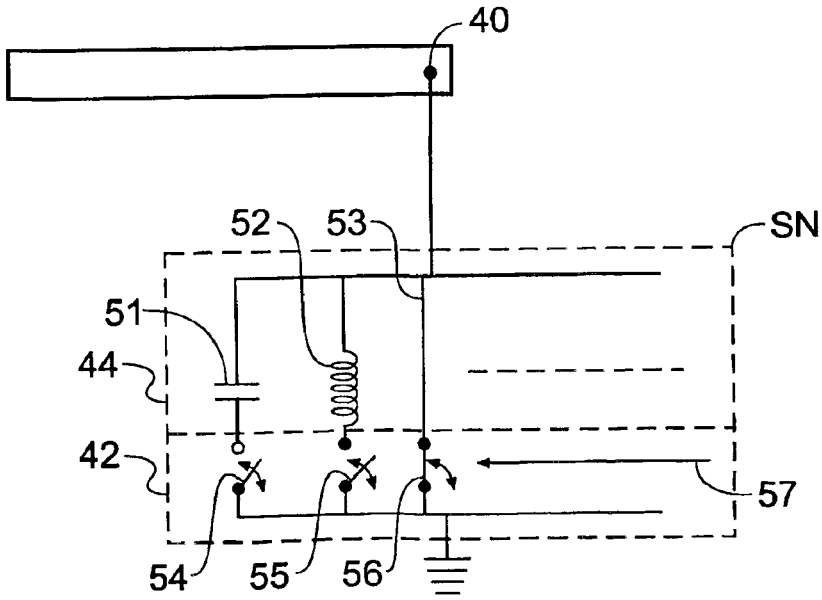
FIG. 5 shows an alternative form of the tunable reactance loading of the antenna of the invention.

FIG. 5 shows the use of a switching network SN based on a Micro ElectroMechanical System. Specifically, FIG. 5 shows the switching network SN including a MEMS switching network 42, and a variable reactance element 44. The switching network SN has an input 40 for connection to the second grounding post GP2, which is then connected to ground through the switching network SN. The variable reactance element 44 includes at least one reactance element, such as a capacitor 51, inductor 52, and short-circuit 53, connected in series with respective switches 54, 55, 56 of the MEMS device 42. Other elements can be provided as required to produce the necessary reactance values. The switches are then operated by a control signal 57, so that the reactive elements are switched into and out of the circuit path, thereby providing different reactance values between the grounding post GP2 and ground.

Thus, the resonance frequency of the second high band resonator HB2 is mainly determined or influenced by: the length of the second conductor portion CP2, which approximately corresponds to one quarter of a wavelength at the second high frequency; the gap between the first conductor portion CP1 and the second conductor portion CP2, and hence the capacitive coupling between them; and the value of the variable reactance connected between the input 40 and ground.

Advantageously, the second high band portion HB2 can be tuned to a resonant frequency close to that of the first high band portion HB1. The two resonant frequencies of the first high band portion HB1 and second high band portion HB2 can be in separate bands or can form one broad band.

In a preferred embodiment of the invention, the bias voltage VDC can take two values, a first of which tunes the second high band portion HB2 of the antenna to a resonance at a second high resonance frequency close to the first high resonance frequency, while the second value tunes the second high band portion HB2 of the antenna to a resonance at a third high resonance frequency, which is also close to the first high resonance frequency, but different from the second high resonance frequency.

The second and third high resonance frequencies can be chosen to be higher or lower than the first high resonance frequency, as desired.

When an electrical signal with frequencies in the frequency band of the second high band portion HB2 is fed to the feeding post FP of the antenna, these signals will be coupled to the second conductor portion CP2, due to the tuning of the capacitive or parasitic coupling existing between the first conductor portion CP1 and the second conductor portion CP2, and corresponding electromagnetic signals will be radiated from the second high band portion HB2 of the antenna as radio waves. When the antenna receives electromagnetic signals in the form of radio waves with frequencies in the frequency band of the second high band portion HB2, electrical signals will, conversely, be generated by the second high band portion HB2 of the antenna, and these signals will be coupled to the first conductor portion CP1, and the thus generated electrical signals are also sensed at the feeding post FP by receiving electronic circuitry connected to the antenna.

Figure 6:
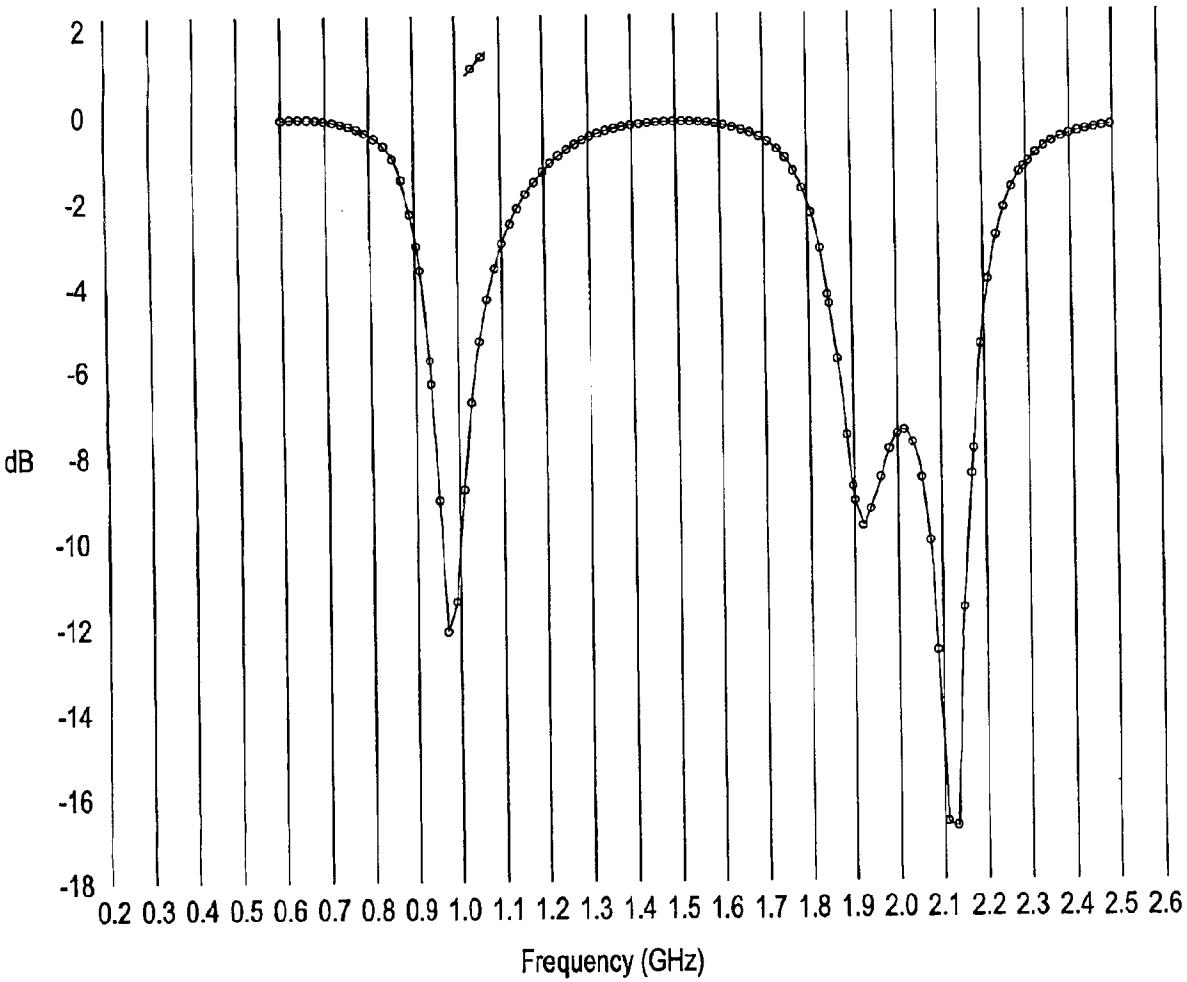
FIG. 6 is a diagram showing a typical return loss for an antenna according to the invention, in a first mode.

FIG. 6 shows a typical return loss for a multi frequency band antenna according to the invention, in a first mode of operation, when the switch is on (that is, VDC is high), the inductor L is shorted out of the circuit by the capacitor C and diode D. The return loss is here drawn on a linear frequency scale from 500 MHz to 2.5 GHz.

It can be seen that the return loss has one distinct minimum at a low frequency band, namely at about 900 MHz, and two minima at two high frequency bands HF2, which are relatively close to each other, namely the PCS band at about 1.9 GHz and the UMTS band at about 2.2 GHz.

Figure 7:
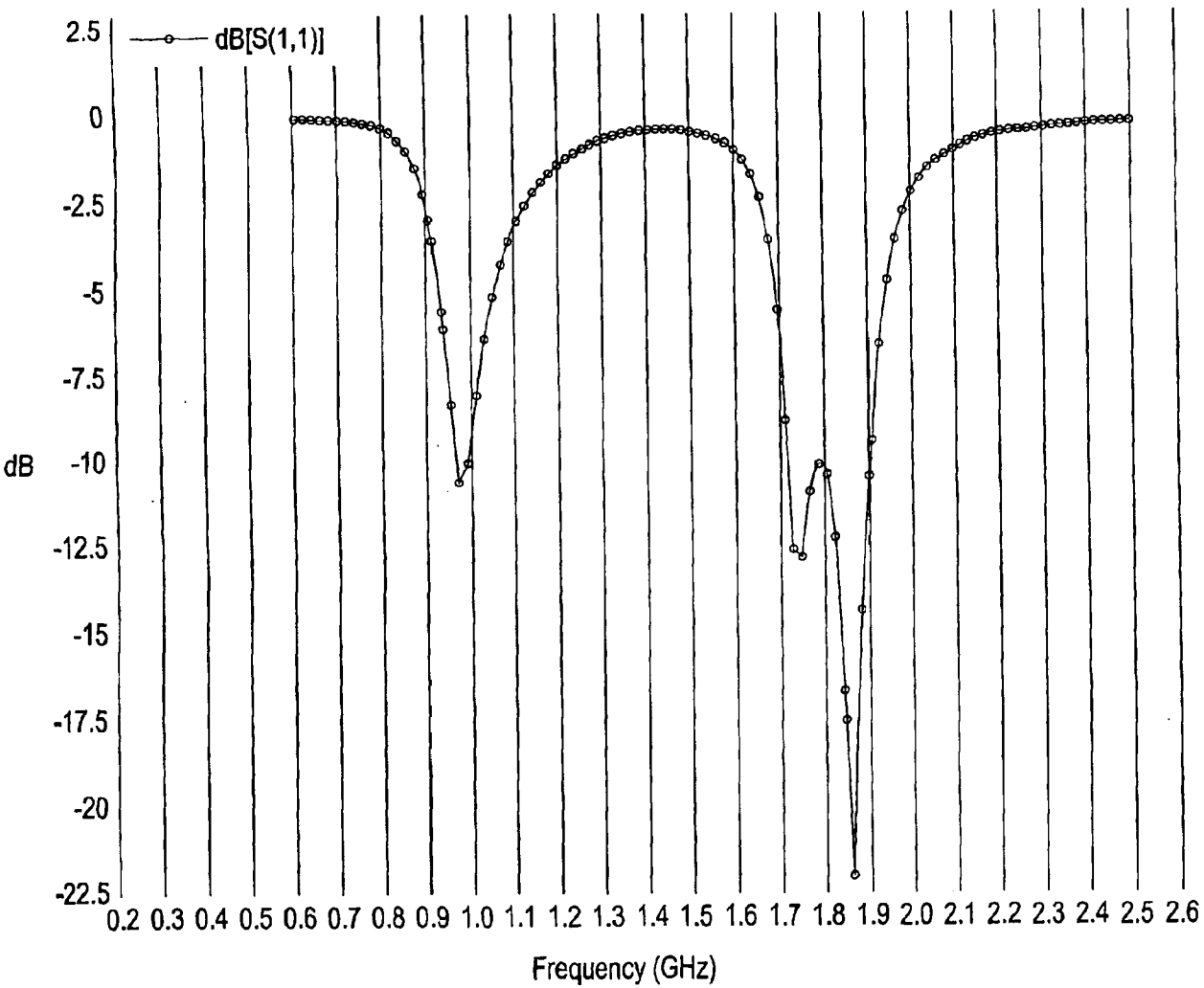
FIG. 7 shows a typical return loss for the antenna, in a second mode.

FIG. 7 shows the typical return loss for the multi frequency band antenna according to the invention, in a second mode of operation, when the switch is off, that is VDC is low (at or close to 0 V), and the inductor L is in the signal path.

In this case, it can be seen that the return loss again has one distinct minimum at a low frequency band, namely at about 900 MHz, because the low resonance frequency is unaffected by the switching, and two minima at two high frequency bands, which again are relatively close to each other, namely the PCS band at about 1.9 GHz and the DCS band at about 1.8 GHz.

The bias voltage VDC can therefore be provided by a control circuit of the phone which controls the mode of operation thereof, thereby ensuring that the antenna is in the first operating mode when UMTS operation is required, and is in the second operating mode when DCS operation is required.

It will be noted in FIGS. 1 and 3 that the first high band portion HB1 of the antenna is arranged on one side of the first linear conductor portion CP1, and the second high band portion HB2 of the antenna is arranged on the opposite side of first linear conductor portion CP1. This has the effect that interference between the two high frequency bands is reduced to a minimum.

In FIG. 3 it is seen most clearly that the active portions of the antenna (including the linear conductor portions CP1 and CP2, and the low and the spiral conductor portions LB, HB1) are spaced from the printed circuit board PCB. In the space between the active portions of the antenna and the PCB there is a dielectric substrate DE with physical dimensions and specific dielectric properties selected for the proper functioning of the antenna. The thickness of the dielectric substrate DE is not necessarily the same as the distance separating the active portions of the antenna from the printed circuit board PCB.

In each case, the bandwidth of the resonance will depend on the size and shape of the respective conductor portion, the thickness of the dielectric material, the dielectric constant of the dielectric material, the size of the antenna patch area, and the distance between the antenna patch and the edge of the PCB.

The conductor portions can be formed by punching from metal plate, or by etching. Although the conductor portions are shown as essentially two dimensional, they can be any two or three dimensional shape.

When used in a mobile telephone, the active portions of the antenna may be placed close to the inner side of a housing wall of the telephone or even fixed or secured thereto, for example by gluing. In that case the dielectric properties of the housing material and their influence on the functioning of the antenna should be taken into account.

There is thus described an antenna arrangement which can be used in a four-band phone.

What is claimed is:

1. A multi frequency band antenna comprising:

a low band portion tuned to a low frequency band; and a first high band portion tuned to a first high frequency band at higher frequencies than the low frequency band;

wherein the low band portion and the first high band portion have:

a common first grounding point;

a common feeding point for feeding input signals to the antenna and for outputting signals from the antenna; and a first conductor portion forming part of the low band portion and of the first high band portion, the first conductor portion being electrically connected to the first grounding point and to the common feeding point, the antenna further comprising:

a second high band portion, coupled to the first conductor portion and to a variable reactance, such that the second high band portion can be selectively tuned either to a second high frequency band or to a third high frequency band, each of the second and third high frequency bands being at a higher frequency than the low frequency band and different from the first high frequency band.

2. An antenna according to claim 1, wherein the second high band portion includes a second conductor portion capacitively coupled to the first conductor portion.

3. An antenna according to claim 1, wherein the first conductor portion and the second conductor portion each include substantially linear portions.

4. An antenna according to claim 3, wherein the second conductor portion is arranged substantially parallel to the first conductor portion.

5. An antenna according to claim 4, wherein the second conductor portion is arranged substantially parallel to the first conductor portion over a length approximately corresponding to one quarter of a wavelength of a frequency in the second high frequency band.

6. An antenna according to claim 1, wherein each of the low band portion and the first high band portion is configured substantially in a spiral form and each branches off from the first conductor portion at a first side thereof.

7. An antenna according to claim 6, wherein the second high band portion is arranged at a second side of the first conductor portion opposite the first side.

8. An antenna according to claim 1, wherein each of the low band portion and the first high band portion includes spirals formed of substantially linear portions of conductive material.

9. An antenna according to claim 8, wherein successive pairs of substantially linear portions of conductive material are arranged substantially at right angles.

10. An antenna according to claim 1, wherein the antenna is supported on a carrier with predetermined dielectric properties.

11. An antenna according to claim 1, wherein the second high band portion has a second grounding point arranged close to the feeding point of the antenna.

12. An antenna according to claim 1, wherein the variable reactance comprises means for switching at least one reactance element into or out of the path between the second high band portion and ground.

13. An antenna according to claim 12, comprising means for receiving a control signal, the reactance element being switched into or out of the path between the second high band portion and ground, in dependence on the control signal.

14. An antenna according to claim 1, wherein the variable reactance comprises a Micro ElectroMechanical System device, which is connected to receive a control signal, the value of the reactance in the path between the second high band portion and ground depending on the control signal.

15. A mobile communications device having an antenna according claim 1.

16. A mobile communications device as claimed in claim 15, comprising means for detecting a desired communications mode, and selectively tuning the second high band portion to the second high frequency band or the third high frequency band in dependence thereon.

* * * * *